United States Patent [19]

Dogliotti

[11] 4,008,809

[45] Feb. 22, 1977

[54] COLUMN-TYPE DISPLAY STAND FOR FLAT PARALLELIPIPEDIC ARTICLES

[75] Inventor: Amilcare Dogliotti, Neive (Cuneo), Italy

[73] Assignee: P. Ferrero & C. S.p.A., Alba (Cuneo), Italy

[22] Filed: July 14, 1975

[21] Appl. No.: 595,635

[30] Foreign Application Priority Data

Nov. 20, 1974 Italy ..... 53612/74[U]

[52] U.S. Cl. ..... 211/71; 248/146

[51] Int. Cl.[2] ..... A47F 5/04; A47F 7/03

[58] Field of Search ..... 206/72, 387, 44.12, 206/45; 211/71, 72, 177, 133, 13, 49 R, 128; 248/150, 152, 174

[56] References Cited

UNITED STATES PATENTS

| | | | |
|---|---|---|---|
| 368,720 | 8/1887 | Johnston | 206/72 |
| 593,024 | 11/1897 | Kinsey | 206/72 |
| 1,892,349 | 12/1932 | Johnsen | 211/71 |
| 2,051,093 | 8/1936 | Leigh | 211/72 |
| 3,372,812 | 3/1968 | Parcels | 206/72 UX |
| 3,710,900 | 1/1973 | Fink | 206/387 X |
| 3,865,247 | 2/1975 | Neglia | 248/152 X |
| 3,926,314 | 12/1975 | Dogliotti | 248/150 X |

*Primary Examiner*—Ramon S. Britts
*Assistant Examiner*—Robert W. Gibson, Jr.
*Attorney, Agent, or Firm*—Sughrue, Rothwell, Mion, Zinn & Macpeak

[57] ABSTRACT

A column-type display stand is comprised of two parallel zig-zag side plates interconnected by a plurality of alternately directed transverse plates to define a plurality of rectangular display chambers inclined in opposite directions. The bottommost chamber is half the size of the remaining chambers and the entire column is supported by a bore having a plurality of apertures for the reception of support devices.

4 Claims, No Drawings

COLUMN-TYPE DISPLAY STAND FOR FLAT PARALLELIPIPEDIC ARTICLES

BACKGROUND OF THE INVENTION

1. Field of the Invention

The present invention relates to column-type display stands for flat parallelipipedic articles such as lozenge containers and the like.

2. Description of the Prior Art

Stands of this type are already known which comprise cavities in which the individual articles are inserted and from which they can be easily removed by the purchaser. The refilling of these stands tends to be a problem in that the articles to be displayed must be inserted one by one into the relevant cavities.

SUMMARY OF THE INVENTION

The present invention is intended to obviate these disadvantages and to provide a column-type display stand which is easily refillable when the displayed articles have all been removed and which allows these articles to be removed with the same ease as the known devices.

The main feature of the column-type display stand according to the invention is that it comprises a supporting base, two zig-zag sides situated in parallel vertical planes and surmounted by plates in the form of circular segments co-planar with the sides and a plurality of transverse plates disposed between the two sides and being alternatively inclined in opposite directions and defining with the sides a plurality of rectangular chambers inclined in opposite directions, each chamber containing a matching containing holding a plurality of articles to be displayed, the longer walls of the containers being provided with vertical ribs defining the spaces provided for the articles.

Other objects, features and advantages of the present invention will be made apparent in the following detailed description thereof which is provided with reference to the accompanying non-limitative drawings.

DESCRIPTION OF THE PREFERRED EMBODIMENT

Figure 1:
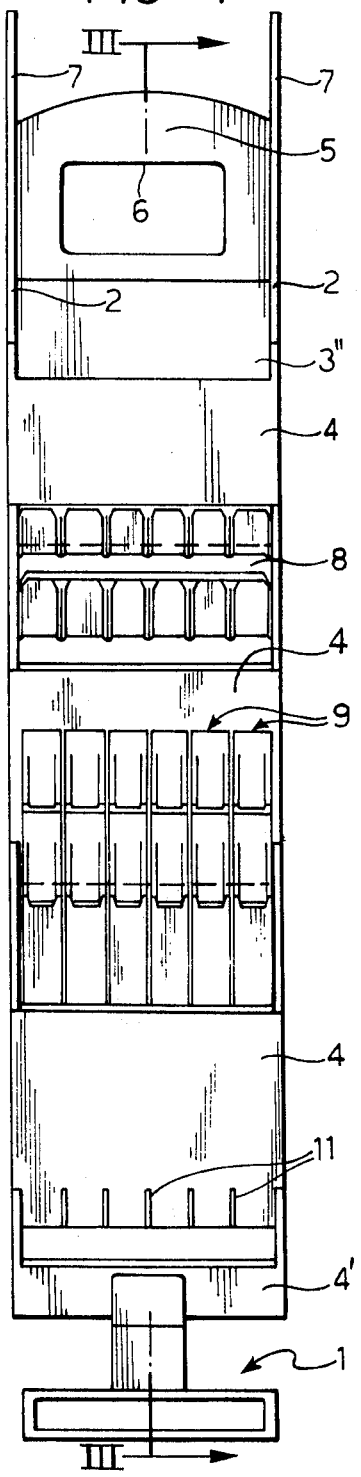
FIG. 1 is an elevational front view of a column-type display stand according to the invention.
Figure 2:
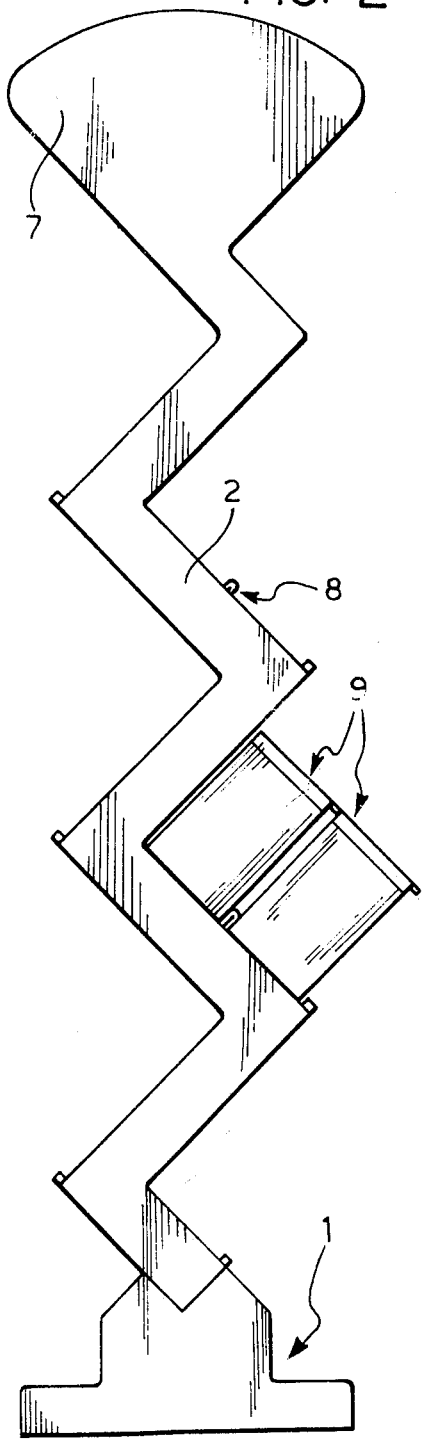
FIG. 2 is a lateral elevational view.

The column-type display stand according to the invention consists of a unitary structure molded from plastics material comprising a lower supporting base 1 upon which a column is mounted. The column is comprised of two zig-zag sides 2 disposed in parallel vertical planes and surmounted by plates 7 in the form of circular segments. A plurality of transverse plates 3, 4, which are interconnected and alternately inclined in opposite directions are disposed between the sides 2. Each transverse plate is joined to the plate beneath substantially perpendicular thereto at a given distance from the end of the same, thus forming a plurality of rectangular chambers inclined in opposite directions, in which are inserted a corresponding number of containers 8 in the form of chambers designed to hold the articles to be displayed.

In the embodiment represented, each container 8 consists of two adjacent interconnected rectangular compartments, the longitudinal side walls of which are provided with spaced apart vertical ribs 18 defining the individual spaces provided for the articles. As a result, two rows of articles 9 project outwardly from each container. The containers are substantially complementary to the chambers and fit snugly therein. An empty container and a full container are shown in place in FIGS. 1 and 3. When a container is empty it can be replaced by a full container, thus rendering refilling of the chambers in the display stand both easy and rapid.

Figure 3:
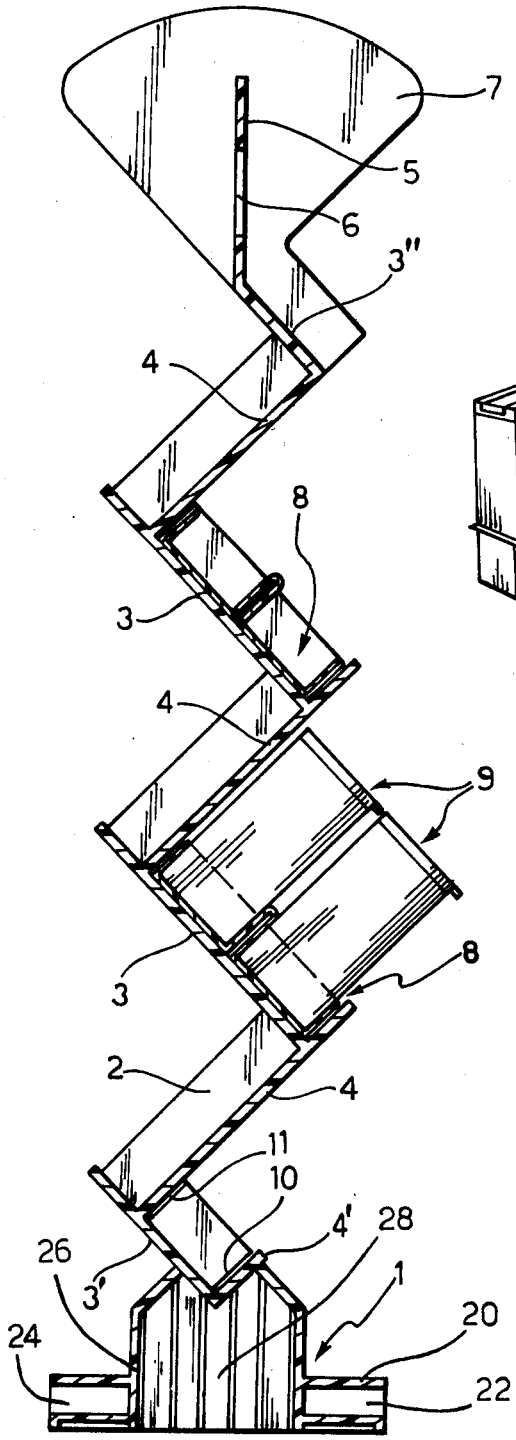
FIG. 3 is a transverse section along the line III—III of FIG. 1.
Figure 4:
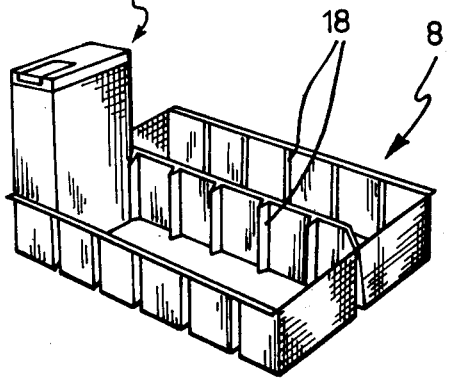
FIG. 4 is a perspective view of one of the containers containing an article to be displayed.

Adjacent to the lower base 1 is a transverse plate 3' of reduced length which is connected to a plate 4' inclined in the opposite direction and of even less width, thus defining a chamber approximately one-half the size of the other chambers. A container having a single compartment for holding a single row of articles can be inserted in this chamber or as illustrated in FIGS. 1 and 3 the longitudinal walls of the lower chamber of the display stand are provided with vertical ribs 10, 11, which enable it to be used directly to hold the articles 9 to be displayed without the use of the interchangeable containers. The ribs support each article in the upright position in the absence of an adjacent article.

At the upper part of the display stand is a transverse plate 3'' of reduced length which is connected to a central vertical plate 5 disposed between the two segments 7 and includes an opening 6 which acts as a handle.

The lower base 1 is comprised of a hollow, rectilinear, horizontally disposed support plate 20 having a pair of laterally opening recesses 22 and 24. A hollow, vertically disposed post 26 extends upwardly through the support plate 20 and defines a downwardly opening recess 28. The side walls of the post 26 are provided with V-shaped notches in which the angularly disposed plates 3' and 4' of the column are secured. The various recesses in the base are adapted to cooperate with suitable support devices to stabilize the display stand or elevate the same.

While the invention has been particularly shown and described with reference to a preferred embodiment thereof, it will be understood by those in the art that various changes in form and details may be made therein without departing from the spirit and scope of the invention.

What is claimed is:

1. A column-type display stand for flat parallelipiped articles comprising a lower supporting base and an upper display column mounted thereon, said column comprising two lateral zig-zag shaped sides disposed in parallel vertical planes and a plurality of interconnected transverse plates connected between the two sides and being alternately inclined in opposite directions so as to define with said sides a plurality of rectangular chambers alternately inclined in opposite directions and rib means on the plates defining at least one of said chambers to define the spaces for the articles, said chamber having said rib means being located adjacent to the lower supporting base and having dimensions smaller than the other chambers in said column and container means having external dimensions substantially identical to the internal dimensions of said other chambers and adapted to fit snugly therein, said container means including two elongated compartments extending in side by side relation for holding two parallel rows of articles and rib means on the longer walls of each elongated compartment to define the spaces for the articles.

2. A column-type display stand for flat parallelipiped articles comprising a lower supporting base and an upper display column mounted thereon, said column comprising two lateral zig-zag shaped sides disposed in parallel vertical planes and a plurlaity of interconnected transverse plates connected between the two sides and being alternately inclined in opposite directions so as to define with said sides a plurality of rectangular chambers alternately inclined in opposite directions and rib means on the plates defining at least one of said chambers to define the spaces for the articles, said transverse plates being disposed perpendicular to each adjacent plate with the uppermost plate of each adjacent pair of plates intersecting and being directly connected to the lower plate of the pair along a line spaced from the upper edge of the lower plate and each of said transverse plates being connected to said zig-zag shaped sides along the lowermost edge of each oppositely directed zig-zag segment constituting said sides.

3. A column-type display stand for parallelipiped articles comprising a lower supporting base and an upper display column mounted thereon, said column comprising two lateral zig-zag shaped sides disposed in parallel vertical planes and a plurality of interconnected transverse plates connected between the two sides and being alternately inclined in opposite directions so as to define with said sides a plurality of rectangular chambers alternately inclined in opposite directions and rib means on the plates defining at least one of said chambers to define the spaces for the articles, said base being comprised of a hollow horizontally disposed support plate and a hollow vertically disposed support post connected to and extending through said hollow support plate, said post defining a downwardly opening recess and said support plate having a pair of opposed laterally opening recesses on opposite sides of said post for the reception of supporting devices.

4. A column-type display stand as claimed in claim 3 wherein said support post includes side members having a V-shaped notch therein in which said display column is secured.

* * * * *